US011723407B2

(12) United States Patent
Li et al.

(10) Patent No.: US 11,723,407 B2
(45) Date of Patent: Aug. 15, 2023

(54) ELECTRONIC CIGARETTE

(71) Applicant: Lanto Electronic Limited, Kunshan (CN)

(72) Inventors: Bin Li, Kunshan (CN); Lin Wu, Kunshan (CN); Xin Tian, Kunshan (CN)

(73) Assignee: LANTO ELECTRONIC LIMITED, Kunshan (CN)

( * ) Notice: Subject to any disclaimer, the term of this patent is extended or adjusted under 35 U.S.C. 154(b) by 393 days.

(21) Appl. No.: 17/032,744

(22) Filed: Sep. 25, 2020

(65) Prior Publication Data

US 2021/0112866 A1 Apr. 22, 2021

(30) Foreign Application Priority Data

Oct. 18, 2019 (CN) ..... 201921752755.1

(51) Int. Cl.

| | |
|---|---|
| ***A24F 40/42*** | (2020.01) |
| ***A24F 40/485*** | (2020.01) |
| ***A24F 40/46*** | (2020.01) |
| ***A24F 40/10*** | (2020.01) |

(52) U.S. Cl.

CPC ..... *A24F 40/42* (2020.01); *A24F 40/10* (2020.01); *A24F 40/46* (2020.01); *A24F 40/485* (2020.01)

(58) Field of Classification Search

CPC ..... A24F 40/485; A24F 40/46; A24F 40/10

See application file for complete search history.

(56) References Cited

U.S. PATENT DOCUMENTS

| | | | | |
|---|---|---|---|---|
| 9,861,135 | B2 * | 1/2018 | Chen | A24F 40/44 |
| 9,986,769 | B1 * | 6/2018 | Liu | A24F 40/40 |

FOREIGN PATENT DOCUMENTS

| | | | |
|---|---|---|---|
| CN | 103315402 | A | 9/2013 |
| CN | 204907926 | U | 12/2015 |
| CN | 108065454 | A | 5/2018 |
| CN | 208286374 | U | 12/2018 |

* cited by examiner

*Primary Examiner* — Jean F Duverne

(74) *Attorney, Agent, or Firm* — Cheng-Ju Chiang

(57) ABSTRACT

The present disclosure discloses an electronic cigarette including a main body and an atomizer. The atomizer is adapted for being detachably mounted to a cartridge. The cartridge includes a containing cavity for storing e-liquid and a sealing film for sealing the containing cavity. The atomizer is provided with a first guide tube, a second guide tube and a heating tube connecting the first guide tube and the second guide tube. The atomizer includes a first end portion and a second end portion at a front end of the atomizer in order to pierce the sealing film. With this configuration, when the cartridge is used up, only a new cartridge needs to be replaced and the atomizer does not need to be scrapped together for saving cost.

20 Claims, 13 Drawing Sheets

ELECTRONIC CIGARETTE

CROSS-REFERENCE TO RELATED APPLICATION

This patent application claims priority of a Chinese Patent Application No. 201921752755.1, filed on Oct. 18, 2019 and titled "ELECTRONIC CIGARETTE", the entire content of which is incorporated herein by reference.

TECHNICAL FIELD

The present disclosure relates to an electronic cigarette which belongs to a technical field of gas atomization devices.

BACKGROUND

Existing electronic cigarettes usually include e-liquid and an atomizer device, where the e-liquid and the atomizer device are usually integrally formed as one piece. When the e-liquid is used up, the e-liquid and the atomizer device need to be scrapped together, which results in a waste of resources.

SUMMARY

An object of the present disclosure is to provide an electronic cigarette with an atomizer which can be reused.

In order to achieve the above object, the present disclosure adopts the following technical solution: an electronic cigarette including a main body, an atomizer mounted to the main body and a cartridge detachably mounted to the atomizer. The cartridge includes a containing cavity for storing e-liquid and a sealing film for sealing the containing cavity. The atomizer includes a first guide tube, a second guide tube and a heating tube in communication with the first guide tube and the second guide tube. The heating tube is adapted to heat and atomize the e-liquid, and the heating tube includes at least one gas outlet. The atomizer includes a first end portion and a second end portion, and the first end portion and the second end portion are located at a front end of the atomizer. The first end portion and the second end portion are adapted to pierce the sealing film.

Compared with the prior art, the cartridge and the atomizer of the present disclosure are detachably installed. With this arrangement, when the cartridge is used up, only a new cartridge needs to be replaced instead of scrapping the cartridge and the atomizer together, which saves costs. In addition, by providing the first end portion, the second end portion, the first guide portion, and the second guide portion, it is convenient to pierce the sealing film and improve the convenience of use.

DETAILED DESCRIPTION

Referring to FIGS. 1 to 12, the present disclosure discloses an electronic cigarette 100 which includes a main body 1, an atomizer 2 mounted to the main body 1 and a cartridge 3 connected to the atomizer 2. In the illustrated embodiments of the present disclosure, the cartridge 3 is detachably mounted to the atomizer 2. With this arrangement, when the cartridge 3 is used up, only a new cartridge 3 needs to be replaced while the atomizer 2 does not need to be scrapped together, which realizes the reuse of the atomizer 2 and saves costs. In order to describe the technical solution of the present disclosure more clearly, in the following descriptions, when the electronic cigarette 100 is described, an end close to the cartridge 3 is defined as a front end, and an end far away from the cartridge 3 is defined as a rear end.

Figure 1:
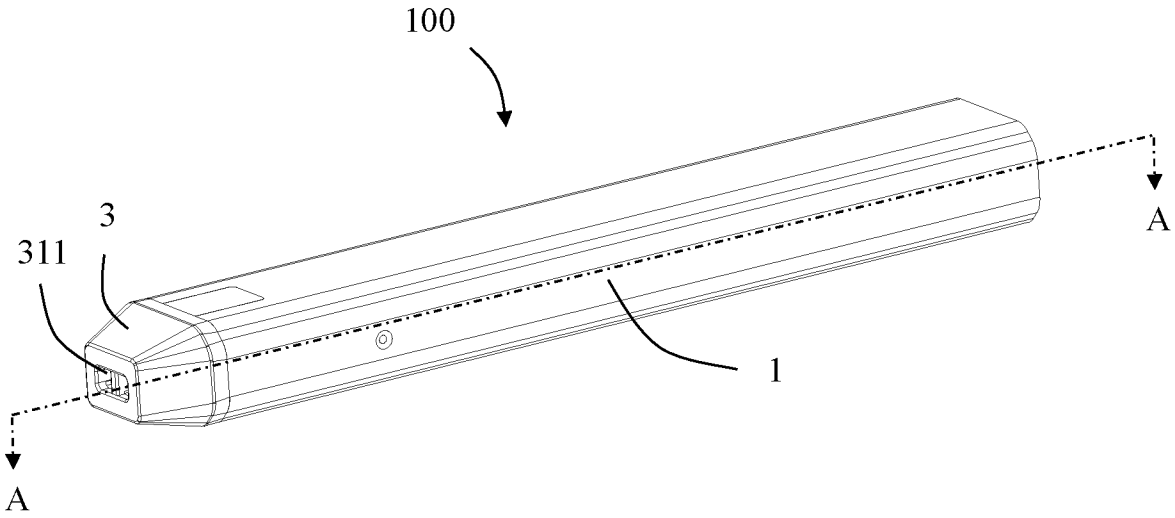
FIG. 1 is a schematic perspective view of an electronic cigarette in accordance with an embodiment of the present disclosure.
Figure 2:
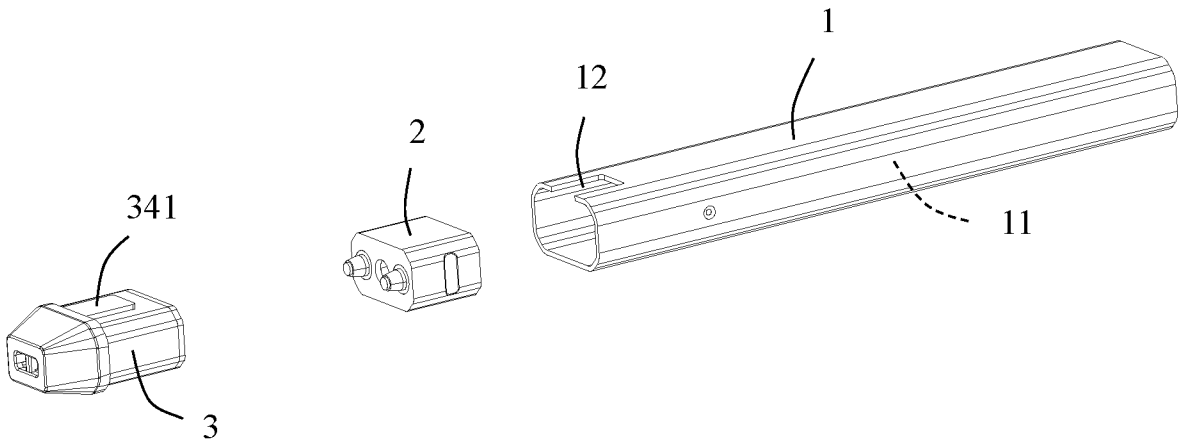
FIG. 2 is a partially exploded view of FIG. 1.
Figure 3:
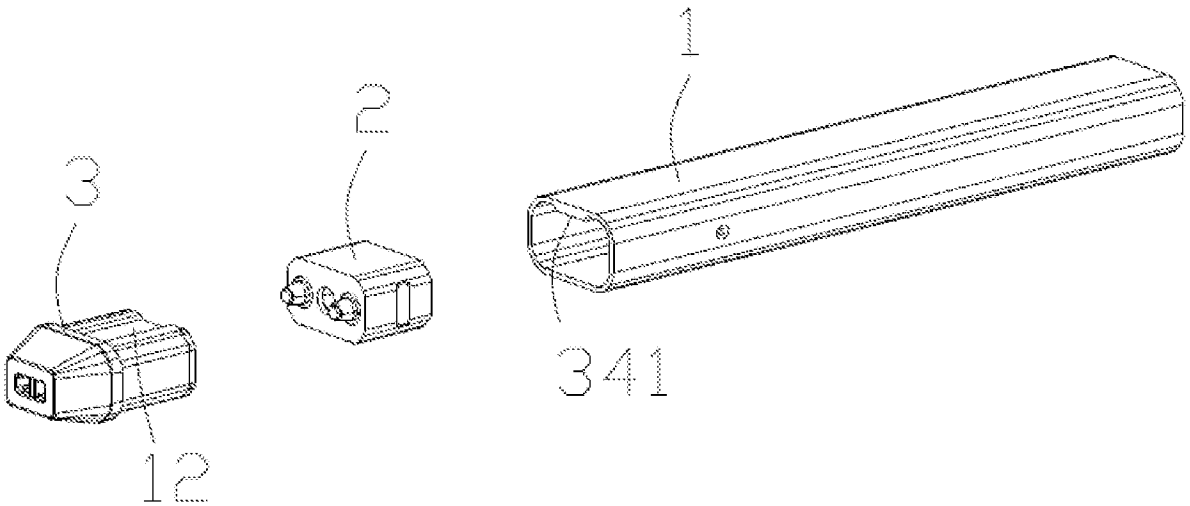
FIG. 3 is a partially exploded view of another electronic cigarette in accordance with another embodiment of the present disclosure.
Figure 4:
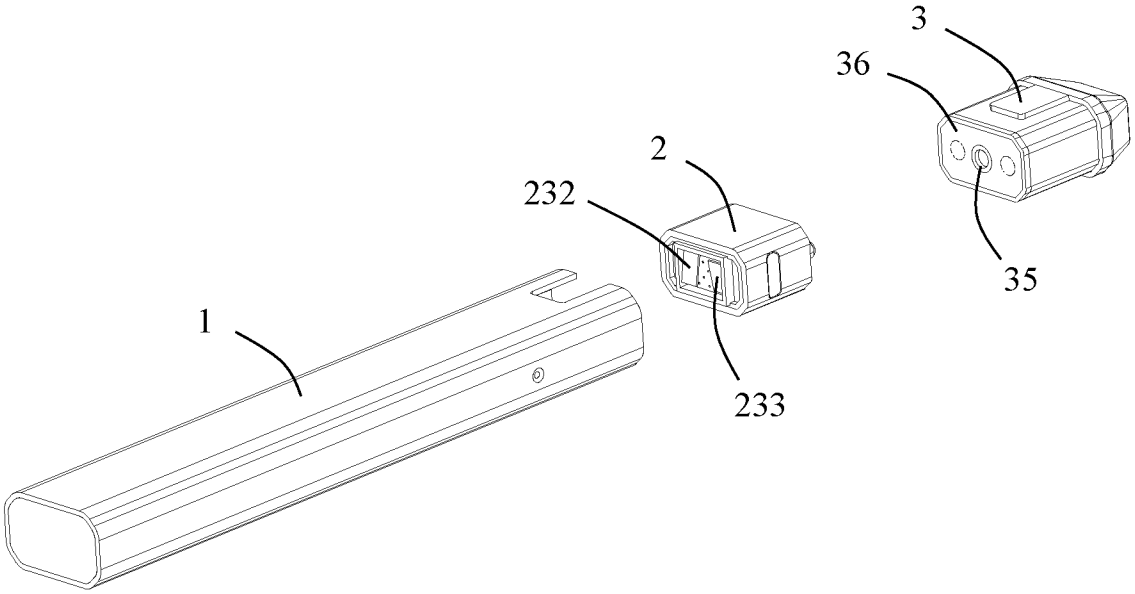
FIG. 4 is an exploded view of FIG. 2 from another angle.
Figure 5:
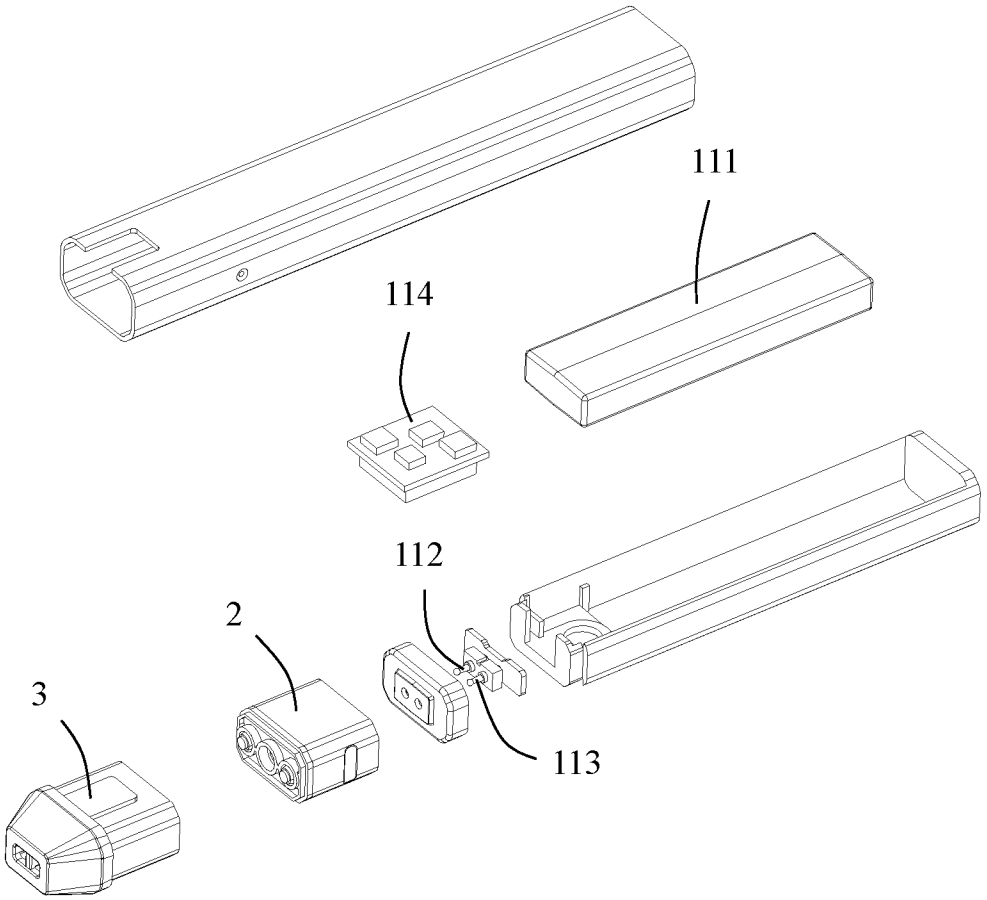
FIG. 5 is a further exploded view of FIG. 2.

Referring to FIGS. 2, 4 and 5, the main body 1 includes an electronic cigarette device 11. The electronic cigarette device 11 includes a power source 111 (such as a battery), a positive contact pole 112, a negative contact pole 113, and a controller 114. The positive contact pole 112 is connected to the power source 111. The negative contact pole 113 is connected to the power source 111. Referring to FIGS. 1 to 3, the cartridge 3 and the main body 1 include positioning structures which are mated with each other. In an illustrated embodiment of the present disclosure, the positioning structures include a first protrusion 341 and a first recess 12. The first protrusion 341 is formed on the cartridge 3, and the first recess 12 is formed on the main body 1. The first protrusion 341 is received in the first recess 12. As shown in FIG. 3, it can be understood that in other embodiments, those skilled in the art can also switch the positions of the first protrusion 341 and the first recess 12. That is, the positioning structures include a first recess 12 formed on the cartridge 3 and a first protrusion 341 formed on the main body 1, and the first protrusion 341 is received in the first recess 12.

Figure 6:
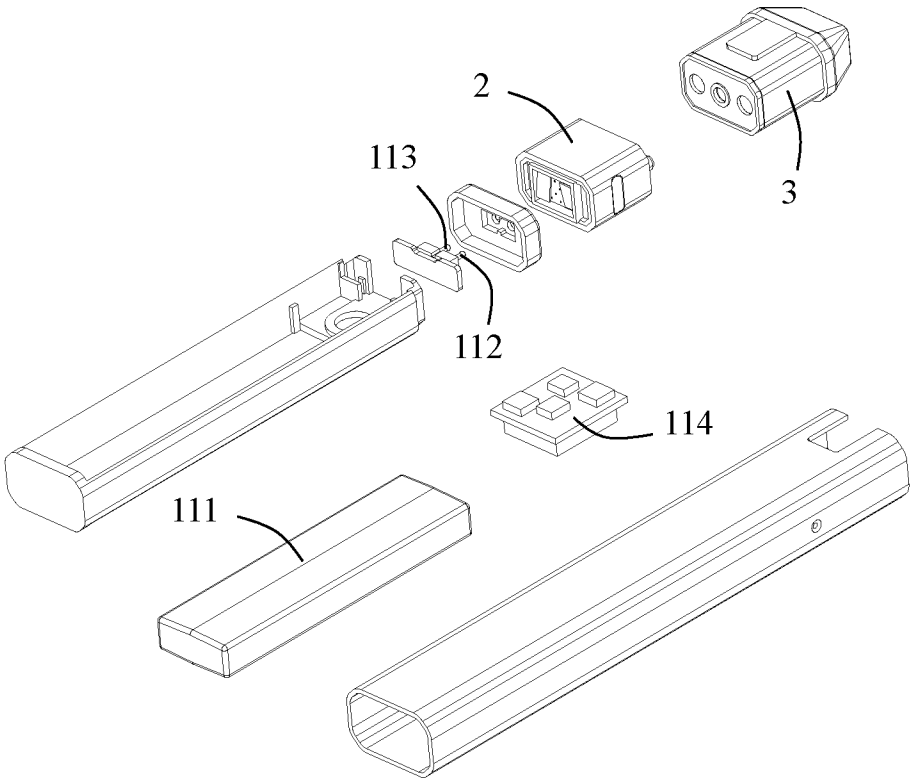
FIG. 6 is a further exploded view of FIG. 4.
Figure 7:
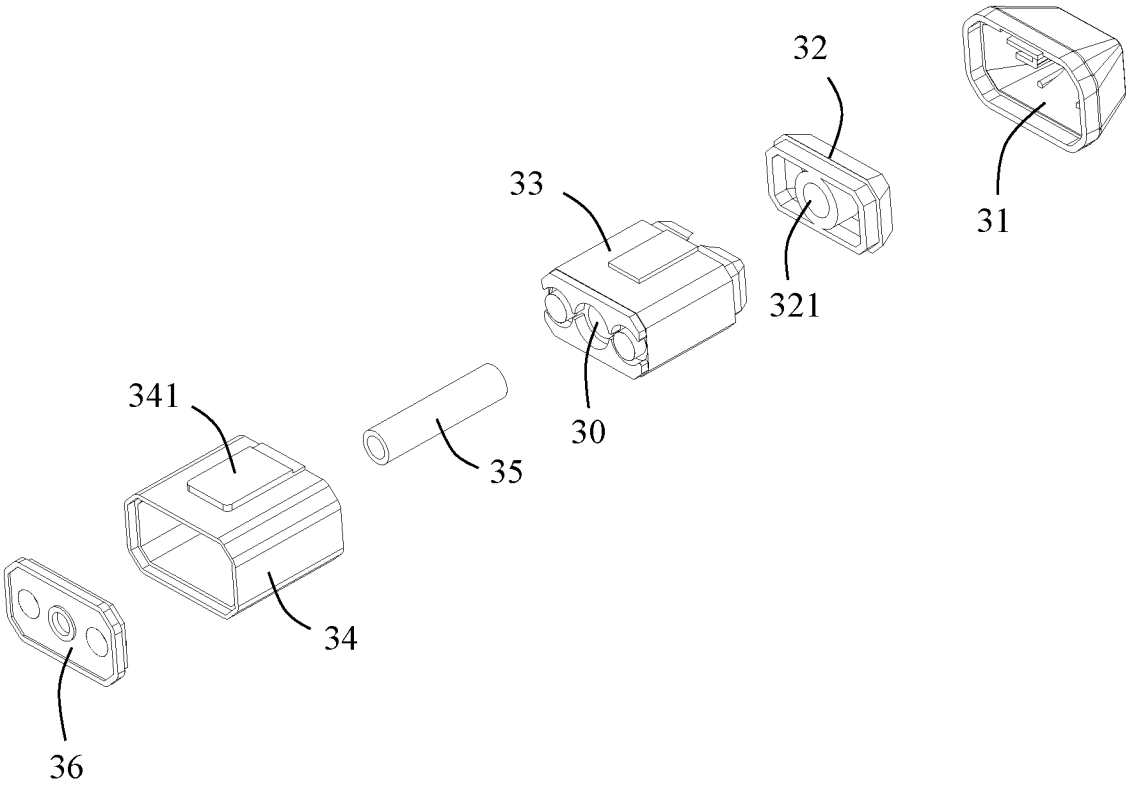
FIG. 7 is an exploded view of the cartridge in FIG. 4.
Figure 8:
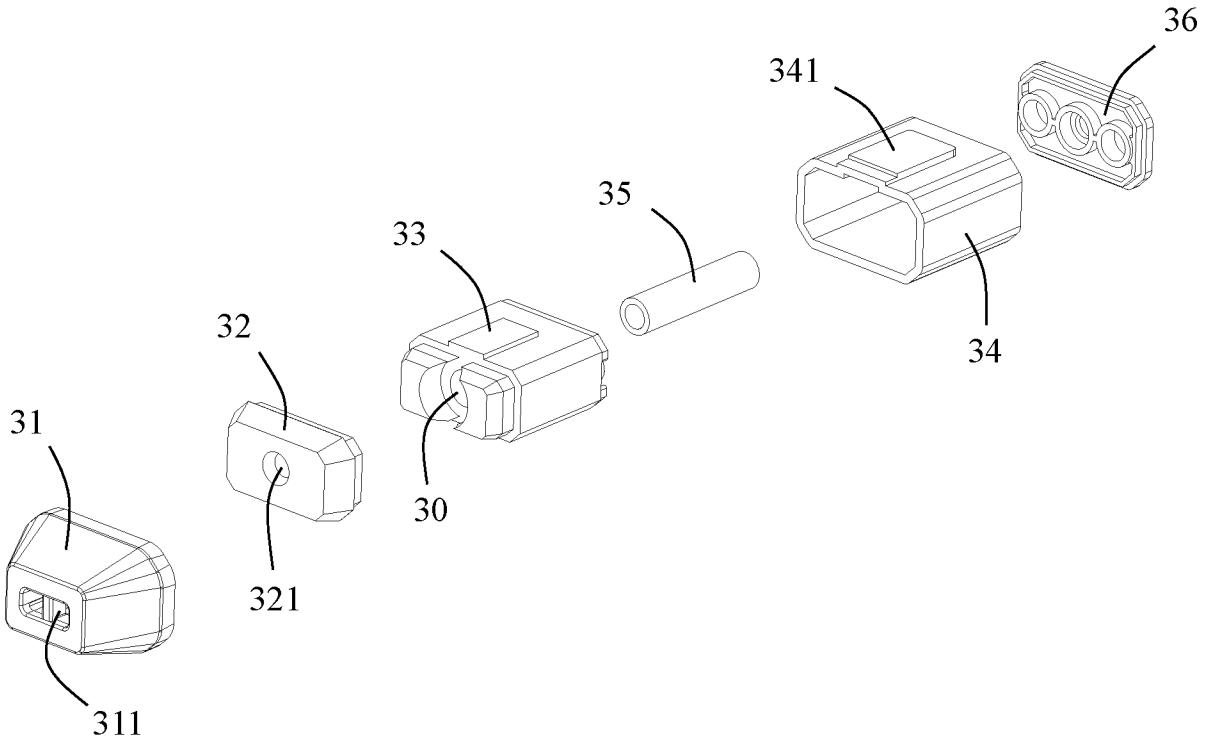
FIG. 8 is an exploded view of FIG. 7 from another angle.

Referring to FIGS. 6 and 7, the cartridge 3 includes a containing cavity 30 and a sealing film 36. The containing cavity 30 is used for storing e-liquid, and the sealing film 36 is used for sealing the containing cavity 30. The above mentioned e-liquid is, for example, aerosol-generating liquid with or without nicotine. Specifically, the cartridge 3 further includes a suction end cover 31, a positioning member 32, a first inner shell 33, a first outer shell 34, and a suction tube 35. The positioning member 32 is installed in the suction end cover 31. The first inner shell 33 mates with the positioning member 32. The first outer shell 34 is sleeved on the first inner shell 33. The suction tube 35 extends through the first inner shell 33. In the illustrated embodiment of the present disclosure, the suction end cover 31 includes an atomizing gas suction port 311, and the suction tube 35 is in communication with the atomizing gas suction port 311. The positioning member 32 includes a through hole 321 for positioning one end of the suction tube 35, and the other end of the suction tube 35 extends through the sealing film 36, such that the other end of the suction tube 35 is exposed to the outside of the sealing film 36. In an embodiment of the present disclosure, the accommodating cavity 30 is provided in the first inner shell 33, and the first protrusion 341 is formed on the first outer shell 34.

Referring to FIGS. 8 to 11, the atomizer 2 includes a first guide tube 21, a second guide tube 22, and a heating tube 23. The heating tube 23 is in communication with the first guide tube 21 and the second guide tube 22. The heating tube 23 is adapted for heating and atomizing the e-liquid. The e-liquid in the present disclosure is, for example, aerosol-generating liquid with or without nicotine. The heating tube 23 includes at least one gas outlet 230. The atomizer 2 includes a first end portion 24, a second end portion 25, a first guide portion 26, and a second guide portion 27. The first end portion 24 and second end portion 25 are located at a front end of the atomizer 2, such that the heating tube 23, the first end portion 24 and the second end portion 25 form a substantially U-shaped structure, and wherein the first end portion 24 is substantially parallel to the second end portion 25, and the heating tube 23 is substantially perpendicular to the first end portion 24 and the second end portion 25. In some embodiments, the first end portion 24 and second end portion 25 are needles. The first guide portion 26 is installed on the first guide tube 21 and located at a rear end of the first end portion 24. The second guide portion 27 is installed on the second guide tube 22 and located at a rear end of the second end portion 25. The first end portion 24 and the second end portion 25 are used to pierce the sealing film 36. The first guide portion 26 and the second guide portion 27 are used to guide the first guide tube 21 and the second guide tube 22 to be inserted into the e-liquid. In the illustrated embodiment of the present disclosure, the first guide portion 26 and the second guide portion 27 are both of tapered shapes so as to better guide the insertion of the first guide tube 21 and the second guide tube 22 into the containing cavity 30.

In the illustrated embodiment of the present disclosure, the first end portion 24 is located at a front end of the first guide tube 21, and the second end portion 25 is located at a front end of the second guide tube 22. In other embodiments, the first end portion 24 and the second end portion 25 may also be provided on the first guide portion 26 and the second guide portion 27, respectively.

Figure 9:
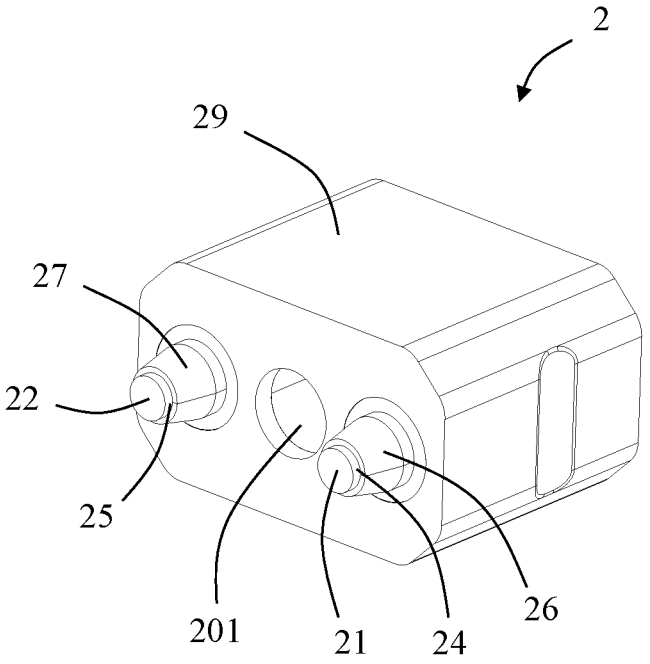
FIG. 9 is a schematic perspective view of the atomizer.
Figure 10:
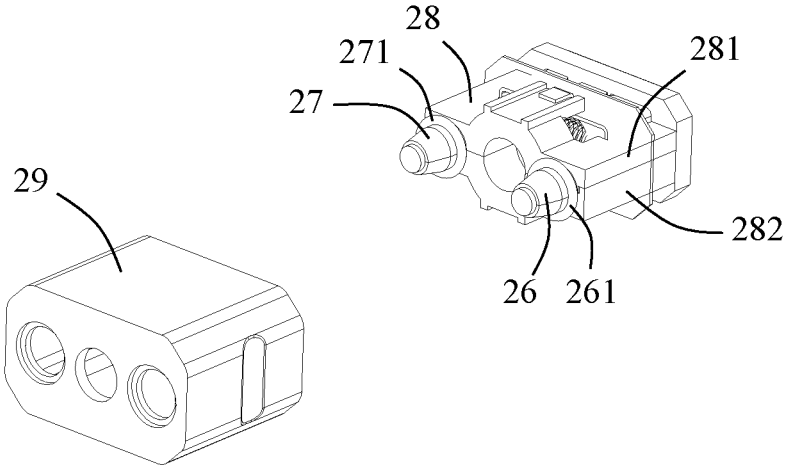
FIG. 10 is a partially exploded view of FIG. 9.
Figure 11:
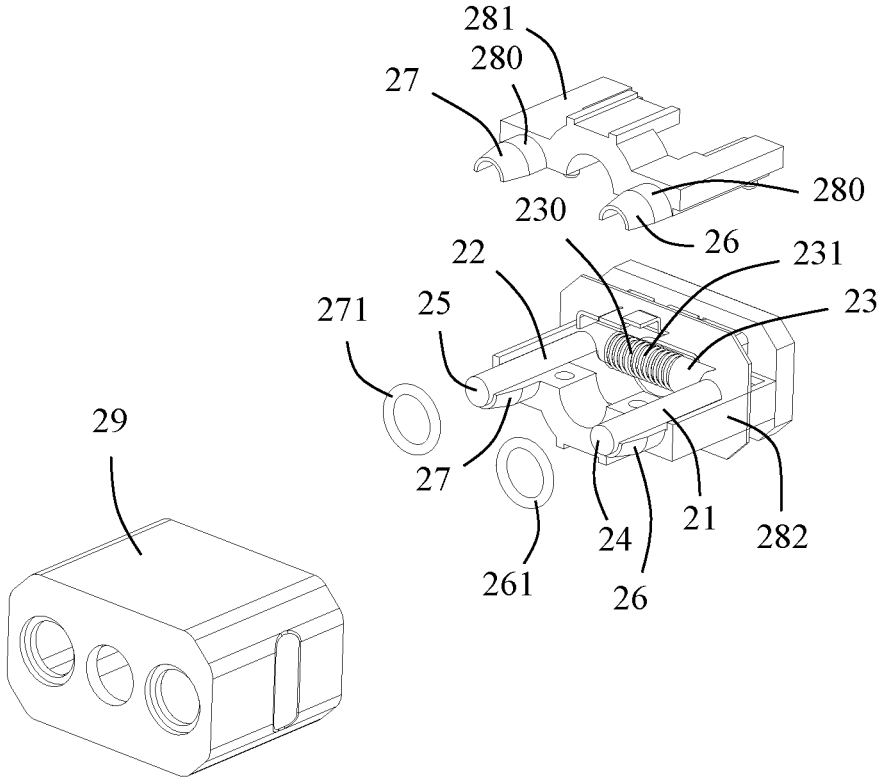
FIG. 11 is a further exploded view of FIG. 10.
Figure 12:
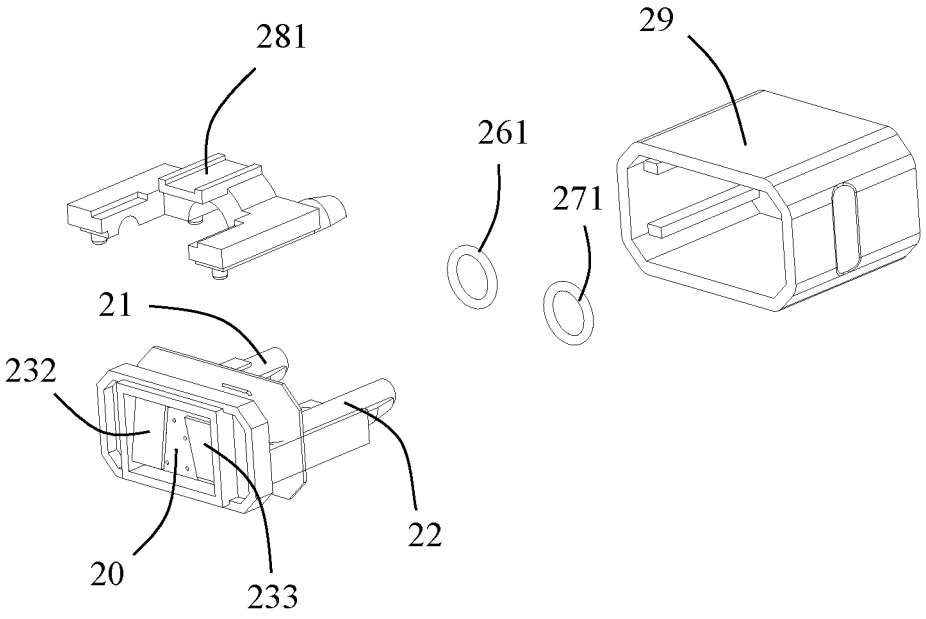
FIG. 12 is an exploded view of FIG. 11 from another angle.
Figure 13:
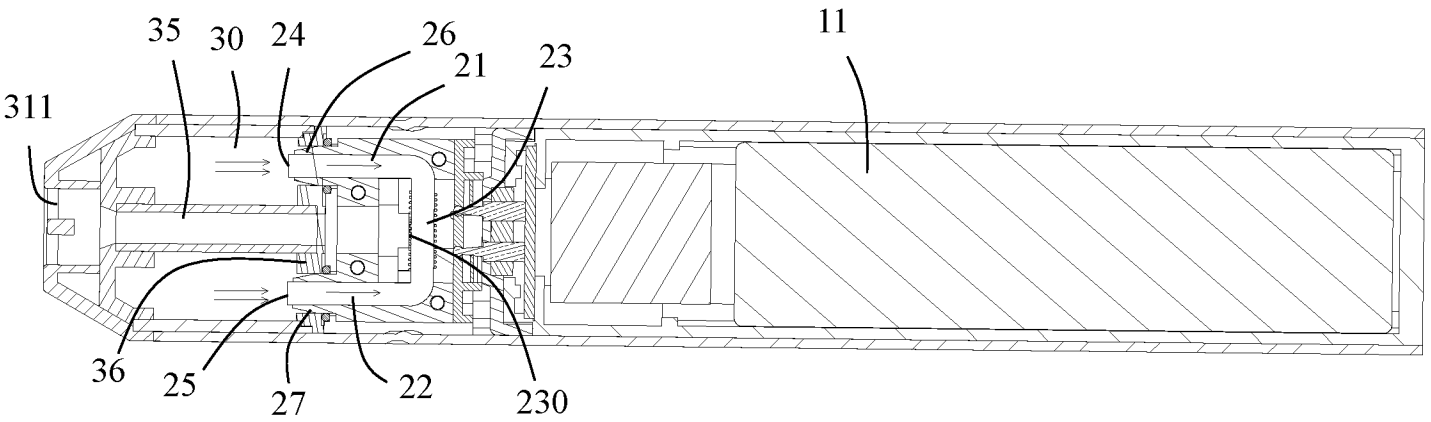
FIG. 13 is a schematic cross-sectional view taken along line A-A in FIG. 1.

Referring to FIGS. 9 to 11, in the illustrated embodiment of the present disclosure, the atomizer 2 includes a housing 28 and a shell 29. The housing 28 is formed on the first guide tube 21 and the second guide tube 22. The shell 29 is sleeved on the housing 28. The housing 28 includes an upper housing 281 and a lower housing 282. The first guide portion 26 and the second guide portion 27 are formed on the upper housing 281 and the lower housing 282, respectively. The atomizer 2 also includes a first sealing member 261 and a second sealing member 271. The first sealing member 261 is sleeved at a rear end of the first guide portion 26. The second sealing member 271 is sleeved at a rear end of the second guide portion 27. Therefore, the e-liquid can be prevented from flowing into places other than the first guide tube 21 and the second guide tube 22. In the illustrated embodiment of the present disclosure, the first sealing member 261 and the second sealing member 271 are both sealing rings. The first sealing member 261 and the second sealing member 271 are both sandwiched between an upper surface 280 of the housing 28 and the sealing film 36.

Referring to FIGS. 10 and 11, the heating tube 23 includes a heating element 231, a positive electrode conductive sheet 232 and a negative electrode conductive sheet 233. The positive electrode conductive sheet 232 and the negative electrode conductive sheet 233 are connected to the heating element 231. In the illustrated embodiment of the present disclosure, the positive electrode conductive sheet 232 and the negative electrode conductive sheet 233 respectively contact the positive electrode contact post 112 and the negative electrode contact post 113 of the power source 111 to heat the heating tube 23 so as to atomize the e-liquid. The heating element 231 is a heating wire, a heating sleeve or a heating sheet.

Referring to FIG. 11, the atomizer 2 includes an air inlet 20 corresponding to the heating tube 23, and the air inlet 20 is in communication with the suction tube 35. Specifically, referring to FIGS. 4, 8 and 12, the suction tube 35 protrudes beyond the sealing film 36, and the atomizer 2 includes a through hole 201 that partially accommodates the suction tube 35. With this arrangement, the heated and atomized e-liquid can reach the atomizing gas suction port 311 through the through hole 201 and the suction tube 35.

The above embodiments are only used to illustrate the present disclosure and not to limit the technical solutions described in the present disclosure. The understanding of this specification should be based on those skilled in the art. Descriptions of directions, such as "front", "back", "left", "right", "top" and "bottom", although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. An electronic cigarette, comprising:

a main body;

an atomizer, mounted to the main body; and a cartridge, detachably mounted to the atomizer, the cartridge comprising a containing cavity and a sealing film, the containing cavity being used for storing e-liquid, and the sealing film being used for sealing the containing cavity; wherein the atomizer comprises a first guide tube, a second guide tube and a heating tube, the heating tube is in communication with the first guide tube and the second guide tube; the first guide tube, the second guide tube and the heating tube jointly form an internal channel to store the e-liquid when the e-liquid flows out of the cartridge; the first guide tube and the second guide tube are configured to gather the e-liquid and guide the e-liquid flowing into an internal tube cavity of the heating tube; wherein the heating tube is adapted to heat and atomize the e-liquid stored in the internal tube cavity, and the heating tube comprises at least one gas outlet through which the e-liquid after atomization flows out of the heating tube; and wherein the atomizer comprises a first end portion and a second end portion, the first end portion and the second end portion are located at a front end of the atomizer, and the first end portion and the second end portion are adapted to pierce the sealing film so that the e-liquid stored in the cartridge is capable of flowing into the first guide tube and the second guide tube.

2. The electronic cigarette according to claim 1, wherein the atomizer comprises a first guide portion and a second guide portion, the first guide portion is mounted to the first guide tube and located at a rear end of the first end portion, the second guide portion is mounted to the second guide tube and located at a rear end of the second end portion; and wherein the first guide portion and the second guide portion are adapted to guide the first guide tube and the second guide tube to be inserted into the e-liquid.

3. The electronic cigarette according to claim 2, wherein the first guide portion and the second guide portion are tapered shapes.

4. The electronic cigarette according to claim 3, wherein the first end portion is located at a front end of the first guide tube, and the second end portion is located at a front end of the second guide tube.

5. The electronic cigarette according to claim 1, wherein the cartridge and the main body comprise positioning structures mated with each other.

6. The electronic cigarette according to claim 5, wherein the positioning structures comprise a first protrusion and a first recess, the first protrusion is formed on the cartridge, the first recess is formed on the main body, and the first protrusion is received in the first recess.

7. The electronic cigarette according to claim 5, wherein the positioning structures comprise a first recess and a first protrusion, the first recess is formed on the cartridge, the first protrusion is formed on the main body, and the first protrusion is received in the first recess.

8. The electronic cigarette according to claim 1, wherein the cartridge comprises an atomizing gas suction port and a suction tube, the suction tube is in communication with the atomizing gas suction port; and wherein the atomizer comprises an air inlet corresponding to the heating tube, and the air inlet is in communication with the suction tube.

9. The electronic cigarette according to claim 8, wherein the suction tube protrudes beyond the sealing film, the atomizer comprises a through hole, and the through hole partially accommodates the suction tube.

10. The electronic cigarette according to claim 2, wherein the atomizer comprises a housing, the housing is formed on the first guide tube and the second guide tube; wherein the first guide portion and the second guide portion are formed on the housing; wherein the atomizer further comprises a first sealing member and a second sealing member, the first sealing member is sleeved on a rear end of the first guide portion, and the second sealing member is sleeved on a rear end of the second guide portion.

11. The electronic cigarette according to claim 10, wherein the first sealing member and the second sealing member are sandwiched between an upper surface of the casing and the sealing film.

12. The electronic cigarette according to claim 1, wherein the heating tube comprises a heating element, a positive conductive sheet and a negative conductive sheet; and wherein the positive conductive sheet and the negative conductive sheet are connected to the heating element.

13. The electronic cigarette according to claim 12, wherein the heating element is a heating wire, a heating sleeve or a heating sheet.

14. The electronic cigarette according to claim 12, wherein the main body comprises an electronic cigarette device, the electronic cigarette device comprises a power source connected to the positive conductive sheet and the negative conductive sheet.

15. An electronic cigarette, comprising:

a main body;

an atomizer, mounted to the main body; and a cartridge, detachably mounted to the atomizer, the cartridge comprising a containing cavity, a sealing film, and an atomizing gas suction port, the containing cavity being used for storing e-liquid, the sealing film being used for sealing the containing cavity; wherein the atomizer comprises a U-shaped tube, and the U-shaped tube comprises a first end portion, a second end portion, and a heating tube, the first end portion is parallel to the second end portion, and the heating tube is perpendicular to the first end portion and the second end portion, the heating tube is in communication with the first end portion and the second end portion; the first end portion, the second end portion and the heating tube jointly form an internal channel to store the e-liquid when the e-liquid flows out of the cartridge; the first end portion and the second end portion are configured to gather the e-liquid and guide the e-liquid flowing into an internal tube cavity of the heating tube; wherein the first end portion and the second end portion are adapted to pierce the sealing film so that the e-liquid is capable of entering the U-shaped tube from entrances of the first end portion and the second end portion; and wherein the heating tube is adapted to heat and atomize the e-liquid stored in the internal tube cavity, and the heating tube comprises at least one gas outlet in communication with the atomizing gas suction port.

16. The electronic cigarette according to claim 15, wherein the atomizer comprises a first guide portion and a second guide portion, the first guide portion is mounted to the first guide tube and located at a rear end of the first end portion, and the second guide portion is mounted to the second guide tube and located at a rear end of the second end portion; wherein the first guide portion and the second guide portion are adapted to guide the first guide tube and the second guide tube to be inserted into the e-liquid; and wherein the first guide portion and the second guide portion are tapered shapes.

17. The electronic cigarette according to claim 15, wherein the cartridge and the main body comprise positioning structures mated with each other.

18. The electronic cigarette according to claim 15, wherein the cartridge comprises a suction tube in communication with the atomizing gas suction port; and wherein the atomizer comprises an air inlet corresponding to the heating tube, and the air inlet is in communication with the suction tube.

19. The electronic cigarette according to claim 18, wherein the suction tube protrudes beyond the sealing film, the atomizer comprises a through hole, and the through hole partially accommodates the suction tube.

20. The electronic cigarette according to claim 15, wherein the heating tube comprises a heating element, a positive conductive sheet and a negative conductive sheet; wherein the positive conductive sheet and the negative conductive sheet are connected to the heating element; and wherein the main body comprises an electronic cigarette device, the electronic cigarette device comprises a power source connected to the positive conductive sheet and the negative conductive sheet.

* * * * *